US005368415A

United States Patent [19]

Kono et al.

[11] Patent Number: 5,368,415

[45] Date of Patent: Nov. 29, 1994

[54] SPIRAL FLIGHTS FOR IMPROVED SOIL MIXING AND EFFICIENT BORING FOR USE ON MULTI-SHAFT AUGER SOIL MIXING APPARATUS

[75] Inventors: Ikuo Kono, Tokyo, Japan; David S. Yang, Fremont, Calif.

[73] Assignee: S. M. W. Seiko, Hayward, Calif.

[21] Appl. No.: 19,022

[22] Filed: Feb. 18, 1993

[51] Int. Cl.[5] ..... E02D 3/12; E02D 5/18

[52] U.S. Cl. ..... 405/267; 405/233; 405/269

[58] Field of Search ..... 405/258, 263, 266, 267, 405/269, 233; 175/323, 394

[56] References Cited

U.S. PATENT DOCUMENTS

| | | | |
|---|---|---|---|
| 4,886,400 | 12/1989 | Taki et al. | 3/12 |
| 4,906,142 | 3/1990 | Taki et al. | 17/13 |
| 4,909,675 | 3/1990 | Taki | 5/18 |
| 5,013,185 | 5/1991 | Taki | 3/12 |
| 5,047,086 | 9/1991 | Hayakawa et al. | 16/2 |
| 5,118,223 | 6/1992 | Taki | 3/12 |

*Primary Examiner*—David H. Corbin
*Attorney, Agent, or Firm*—Workman, Nydegger & Jensen

[57] ABSTRACT

An apparatus for constructing subterranean structures, soil-chemicals mixture or soil-agents mixture by using a multi-shaft auger machine to mix soil with a chemical hardener in situ. As the auger shafts of the multi-shaft auger machine penetrate the soil, spiral flights attached to the auger shaft above the initial auger blades assist soil in passing by supporting structures located between adjacent auger shafts. The spiral flights both assist in raising the soil beyond the supporting structures and also prevent reagglomeration of the soil prior to passing by the supporting structures. The spiral flights have a diameter less than that of the auger blades attached to the shaft below the spiral flights and have a connection ranging from 360 degrees to 720 degrees around the shaft. The use of the spiral flights within this location results in a reduction in the amount of energy needed to auger a borehole, thereby resulting in excess energy for a more homogeneous mixing of the chemical hardener in the soil through which the auger passes. In addition to the increase in efficiency because of the available energy, the spiral flights also directly increase the surface area of structures attached to the auger shaft thereby increasing the mixing efficiency of the auger shaft as it passes through the borehole. The increased efficiency and the prevention of reagglomeration of soil are most beneficially observed in clay or clay-like soils.

16 Claims, 4 Drawing Sheets

SPIRAL FLIGHTS FOR IMPROVED SOIL MIXING AND EFFICIENT BORING FOR USE ON MULTI-SHAFT AUGER SOIL MIXING APPARATUS

BACKGROUND

1. Field of the Invention

The present invention relates to multi-shaft auger systems and processes for mixing soil with a chemical hardener in situ to form soil-cement columns, walls, piles, grids and monolithic block of overlapping columns. More particularly, the present invention is directed to improvements in auger shafts which permit more efficient penetration and improved mixing of the chemical hardener with the soil which forms the soil-cement columns, walls, piles, grids, and monolithic block of columns.

2. The Relevant Technology

The term "chemical hardener" includes any chemicals and agents that can be added and mixed with soil to cause chemical reactions. Examples of chemicals and agents are: portland cement, lime, fly ash, kiln dust, cement-based hardeners, bitumen, resin, power plant residues, bentonite, salts, acids, sodium and calcium silicates, calcium aluminates, and sulfates. The chemical reactions include possolanic reaction (cementation), hydration, ion-exchange, polymerization, oxidation, and carbonation. The results of these chemical reactions include changes in the physical properties of soil such as strength and permeability and/or the change of chemical properties such as the reduction of the toxicity level in contaminated soil or sludge. The chemical hardener is added in a slurry form. Therefore, the term "slurry" as used herein is defined as including chemical hardener. A soil-cement column is one of the most common products of in situ mixing of soil and chemical hardener, so it is used as a generic term to describe the hardened product of in situ soil mixing. In some cases, non-hardening soil-chemical or soil agent mixtures are desirable and should be considered within the scope of this invention.

For a number of years, multi-shaft auger machines have been used to construct soil-cement columns in the ground without having to excavate and remove the soil. These columns are sometimes referred to as "soilcrete" columns, because the soil is mixed with a cement slurry. Upon hardening, the soil-cement columns possess some characteristics of lower strength concrete columns, but they are constructed without the expense and time-consuming process of removing and replacing the soil with concrete. Cement slurry has also been called cement grout or cement milk in some of the previous art.

Soil-cement columns have been arranged in a variety of patterns depending on the desired application. Soil-cement columns are used to improve the load bearing capacity of soft soils, such as sandy or soft clay soils. The columns are formed deep in the ground to help support surface construction on soft soils.

In other cases, the soil-cement columns have been overlapped to form boundary walls, excavation support walls, low to medium capacity soil-mixed caissons, and for the in situ fixation of contaminated soil or toxic wastes.

To produce soil-cement columns, a multi-shaft auger machine bores holes in the ground and simultaneously mixes the soil with a slurry or slurties of chemical hardener pumped from the surface through the auger shaft to the end of the auger. Multiple columns are prepared while the soil-cement mixture or soil-chemical mixture is still soft to form continuous walls of geometric patterns within the soil depending on the purpose of the soil-cement columns.

Because the soil is mixed in situ and because the soil-cement wall is formed in a single process, the construction period is shorter than for other construction methods. Obviously, the costs of forming soil-cement columns are less than traditional methods requiring excavation of the soil, constructing forms, and then pouring concrete into the forms in order to form the concrete pillars or walls. In addition, because the soil is not removed from the ground, there is comparatively less material produced in situ by such processes that must be disposed of during the course of construction.

Historically, a modified earth digging auger machine is used in the formation of in situ soil-cement columns. The boring and mixing operations are performed by multi-shaft drive units in order to make the process more efficient. The shafts typically have attached soil mixing paddles and auger blades which horizontally and vertically mix the soil with the hardening material, thereby producing a column having a homogeneous mixture of the soil and the chemical hardener.

As auger blades located at the lower end of each shaft of a multi-shaft drive unit penetrate the soil, the soil is broken loose and a chemical hardener slurry is injected into the soil through the ends of the hollow-stemmed augers which are attached to the shaft. The augers penetrate, break loose, and lift the soil to mixing paddles which further blend the slurry in the soil.

Due to the tremendous forces required to push the shaft downward and to turn the augers and the shaft, as well as the tendency of the multiple shafts to diverge due to varying soil conditions encountered by each shaft, support structures are provided which surround each shaft. The support structures allow the shafts to rotate, while simultaneously providing lateral support.

Support structures typically take the form of nonrotating bands surrounding each shaft and stabilizing bars securely attached to the nonrotating bands to maintain proper shaft spacing and alignment. These nonrotating bands and stabilizer bars can be constructed as separate elements or as a single unitary piece.

Typically, these bands and stabilizer bars are constructed to be removable for easy assembly and disassembly of the shafts of the multi-shaft drive unit and for easy repair and replacement of the auger blades and mixing paddles themselves. As these supporting structures serve to prevent diversion of the auger shafts out of a parallel configuration, the support structures must be located fairly near to the lower ends of the shafts where the impact of rocks and varying soil textures has the most effect on the shafts.

As the augers penetrate new soil, the soil is loosened and the loosened soil is forced past the nonrotating bands and stabilizer bar by the action of the rotating auger blades pushing soil up from below. As the newly loosened soil is urged past the support structures by the action of the auger blades at the lower end of the shaft, resistance is encountered in the vicinity of the nonrotating bands and stabilizer bar.

The passage of the soil around these support structures causes an increase in friction, a concomitant decrease in efficiency of mixing, a reduction in the rate of progress of the shaft through the soil, and a proportional increase in the amount of energy utilized to prepare a soil-cement column. After passing the nonrotating band and stabilizer bar, the soil is remixed with mixing paddles attached to the shaft above the nonrotating band and stabilizer bar.

While this auger system works well in sandy or porous soils, problems are encountered when auguring in clay or clay-like soils. When the auger blades located at the end of each shaft encounter clay soils, the augers fracture and separate the clays only to have the clays reaggregate before passing the nonrotating bands and stabilizer bar which support the shafts. This reaggregation or reagglomeration of clay soil can form a cylindrical plug. The natural tendency of clays to stick and coalesce is further exacerbated by the injection of the slurry. When combined with the slurry, the cylindrical clay plug greatly increases resistance to the passage of supporting structures such as the nonrotating band and stabilizer bar therethrough.

When sufficient pressure is exerted on the clay plug by the action of the augers on new soil being forced up from below, the clay plug is forced around the nonrotating bands and stabilizer bar into the area of the borehole above the supporting structures. Once the cylindrical plug reaches the mixing blades located above the supporting structures, the cylindrical plug must once again be fractured and separated and thoroughly mixed with the slurry. This reseparation further slows the progress of the augers by reducing the energy available for penetrating additional layers of soil.

The resistance caused by the reconsolidation of the clay soil below the supporting structures results in a reduced rate of progress by the auger machine through the soil. Further, there is significantly less homogenous mixing of the soil with the slurry. The cylindrical plug reformed beneath the support structures must undergo essentially the same fracturing process above the support structures as the process the soil was subjected to below the structures. The mixing blades and paddles located on the shafts above the supporting structures must not only mix the soil but also refracture and reseparate it.

As the soil must be separated twice, much more energy is utilized in the mixing process. This energy must be deducted from the total energy available for penetrating new soil layers. This reduction in available energy results in less efficient boring, both in rate of progress through the soil and in the thoroughness of mixing of the soil with the slurry.

From the foregoing, it will be appreciated that what is needed in the art is a multi-shaft auger system which increases the rate of progress of an auger machine through clay soils.

It would be another advancement in the art to provide a multi-shaft auger system for mixing soil with a chemical hardener in situ, which provides for a more homogenous mixture of a chemical hardener slurry and a clay soil.

It would be a further advancement in the art to provide a multi-shaft auger system which uses less energy when penetrating clay soils.

It would be a still further advancement in the art to provide a multi-shaft auger system which prevents the formation of clay soil cylindrical plugs below the support structures of the auger system.

OBJECTS AND BRIEF SUMMARY OF THE INVENTION

It is, therefore, an object of the present invention to provide a multi-shaft auger system for mixing soils with a chemical hardener in situ which increases the rate of progress of an auger machine through clay soil.

It is another object of the present invention to provide a multi-shaft auger system which uses less energy when penetrating clay soils.

A further object of the present invention is to provide a multi-shaft auger system which prevents the formation of clay soil's cylindrical plugs below the support structures of the auger system.

It is a still further object of the present invention to provide a multi-shaft auger system for mixing soil with the chemical hardener which provides for a more homogeneous mixture of a chemical hardener slurry and a clay soil.

To achieve the foregoing objects, and in accordance with the invention as embodied and broadly described herein, a multi-shaft auger system for mixing soil with a chemical hardener in situ is provided in which the multi-shaft auger apparatus comprises at least two substantially parallel shafts.

The shafts are rotated into the soil by means for rotating the shafts. The means for rotating the shafts comprise a motor transferring power through a gearbox which is attached to the top of the shafts. Affixed to the lower end of each of the hollow shafts is an auger blade capable of penetrating undisturbed soil to propel the shaft downwardly.

As the auger shaft travels downwardly, the auger blade breaks up the undisturbed soil and pushes it in an upward direction while concomitantly injecting a chemical hardener slurry into the soil and mixing the slurry with the soil therewith. The means for injecting the chemical hardener into the soil comprise openings formed in the bottom end of each of the shafts and in the auger blades which discharge the chemical hardener sometimes referred to generically "cement milk" or as "cement grout" to form a generally homogeneous mixture of chemical hardener slurry and soil.

A support structure comprising cylindrical collars spaced apart on each shaft allows the shaft to rotate within the collars. Nonrotating bands surround each shaft at the area between the cylindrical collars and, by using bearings, allow the shaft to rotate within the nonrotating bands. A stabilizer bar is securely attached to the nonrotating bands to maintain proper spacing between the shafts and to maintain alignment of the shafts.

The present invention also provides for soil movement assisting means for aiding in the movement of broken soil around these support structures. In one embodiment of the present invention, the soil movement assisting means comprise a spiral auger flight affixed to the shaft in the area immediately below the support structure. The auger flight serves to fracture any cylindrical plugs reaggregated after passing by the auger blades at the bottom of the auger shaft. By fracturing the cylindrical clay soil plugs, the movement of the soil around the supporting structures is speeded, thereby reducing the resistance encountered by the entire apparatus as it passes deeper into the soil. In some cases, the clay soil will not have had sufficient time to reagglomerate into a cylindrical plug before encountering the spiral flight. In this case, the spiral flight serves to increase the mixing effect of slurry and soil while preventing the reagglomeration of the clay soil prior to passage by the support structures.

The benefits of the fracturing of the cylindrical plug by the auger flight before the complete formation thereof results in the use of less energy in boring the hole. The energy saved may be utilized in increasing the rate of progress of the auger shaft into new layers of soil. More energy is also available to more thoroughly mix the soil into a homogeneous blend of soil and slurry.

In addition, the spiral flights serve to push the soil upward, thereby decreasing the load borne by the augers in pushing the soil upward. This assistance in upward movement of the soil results in an increased rate of penetration through the soil.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
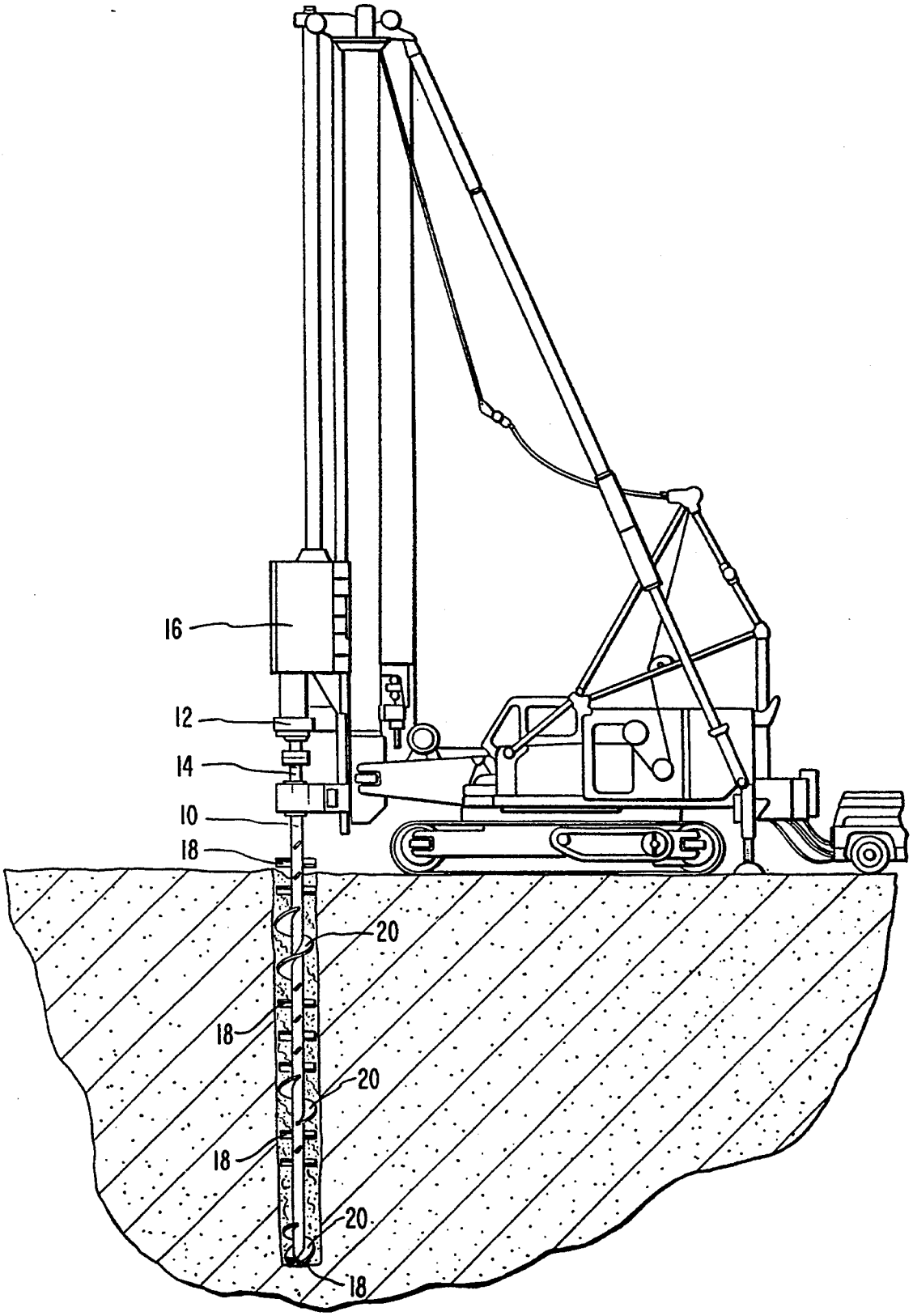
FIG. 1 (PRIOR ART)
FIG. 1 is a vertical cross-sectional view illustrating the environment in which prior art auger shafts operate.

Reference is now made to the drawings wherein like parts are designated with like numerals throughout. Referring initially to FIG. 1, a prior art multi-shaft auger machine is illustrated as the machine would appear in operation.

Each shaft of the multi-shaft auger machine, shown generically as shaft 10, is attached to a gearbox 12 at an upper end 14. A motor 16 transfers power through gearbox 12 to each shaft. Spaced throughout the length of each shaft are intermittent soil mixing paddles 18 and auger blades 20.

The auger blades 20 break up the soil and vertically mix the soil with a chemical hardener which is injected into the soil surrounding the shafts. The soil mixing paddles 18 further assist to break up the soil and homogeneously mix the soil with the chemical hardener.

Figure 2:
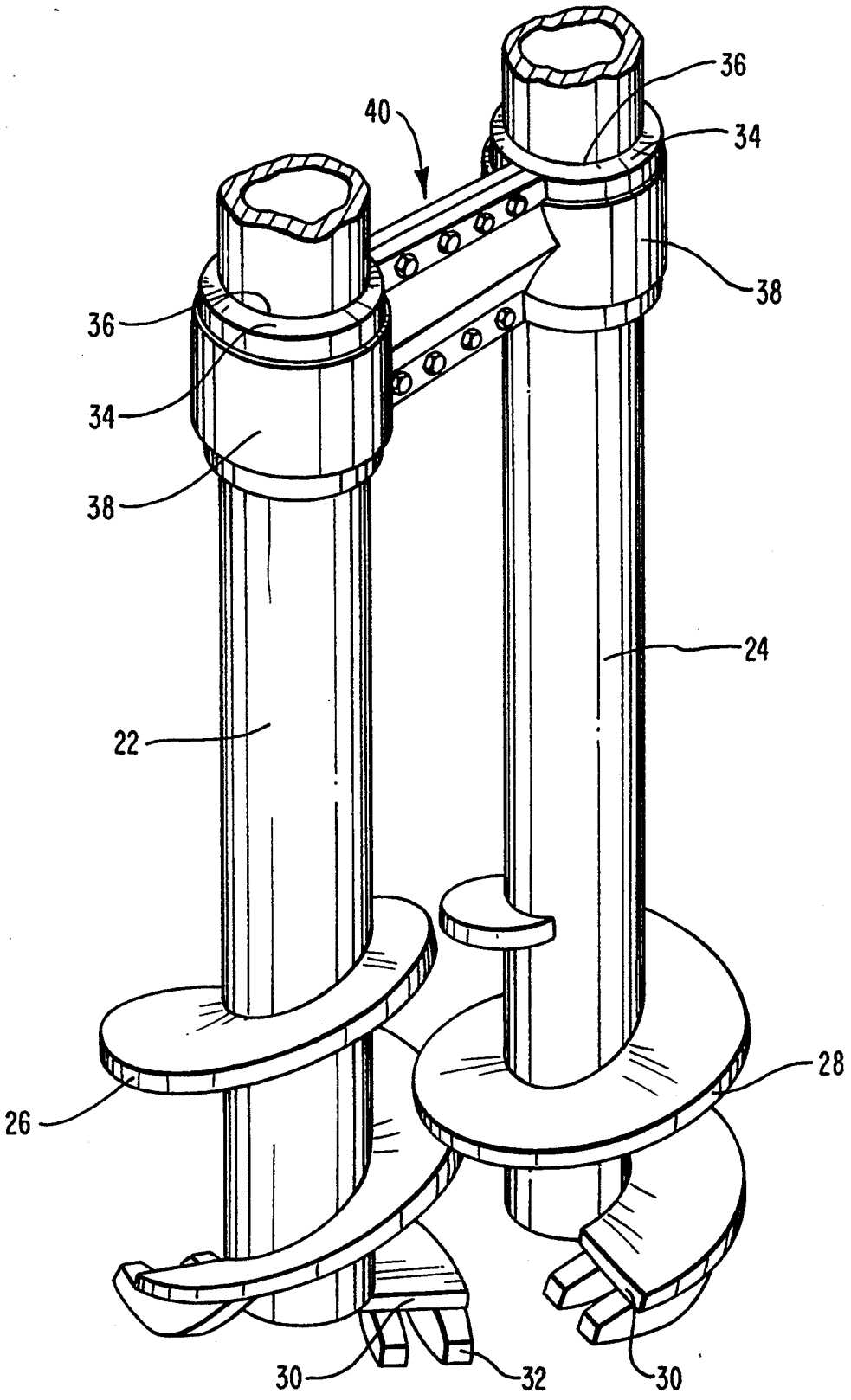
FIG. 2 is an enlarged prospective view of the terminal ends of two-auger shafts like those used in the prior art.

FIG. 2 illustrates the details of a prior art two-shaft auger machine. The auger machine contains a first shaft 22 and a second shaft 24. Attached to the end of first shaft 22 and second shaft 24 are first auger blade 26 and second auger blade 28, respectively. The first and second auger blades each possess an auger cutting edge 30 which cuts into the soil at the bottom of each borehole. Auger teeth 32 are preferably secured to the cutting edge of the first and second auger blades in order to assist in soil penetration in clay or rocky soils.

Both first shaft 22 and second shaft 24 have cylindrical collars 34 spaced apart and formed around the periphery 36 of each shaft. Collars 34 rotate with the shaft. Nonrotating bands 38 surround each collar. Conventional bearing means (not shown) allow the collars to rotate within the nonrotating bands.

A stabilizer bar 40 is securely attached to the nonrotating bands to maintain proper shaft horizontal spacing and alignment. While nonrotating bands 38 and stabilizer bar 40 are illustrated as separate elements, it will be appreciated that they may be constructed of a single unitary piece. In addition, the bands and stabilizer bar may be constructed to be removable for easy assembly and disassembly of the shafts of the auger machine for repair and replacement.

Figure 3:
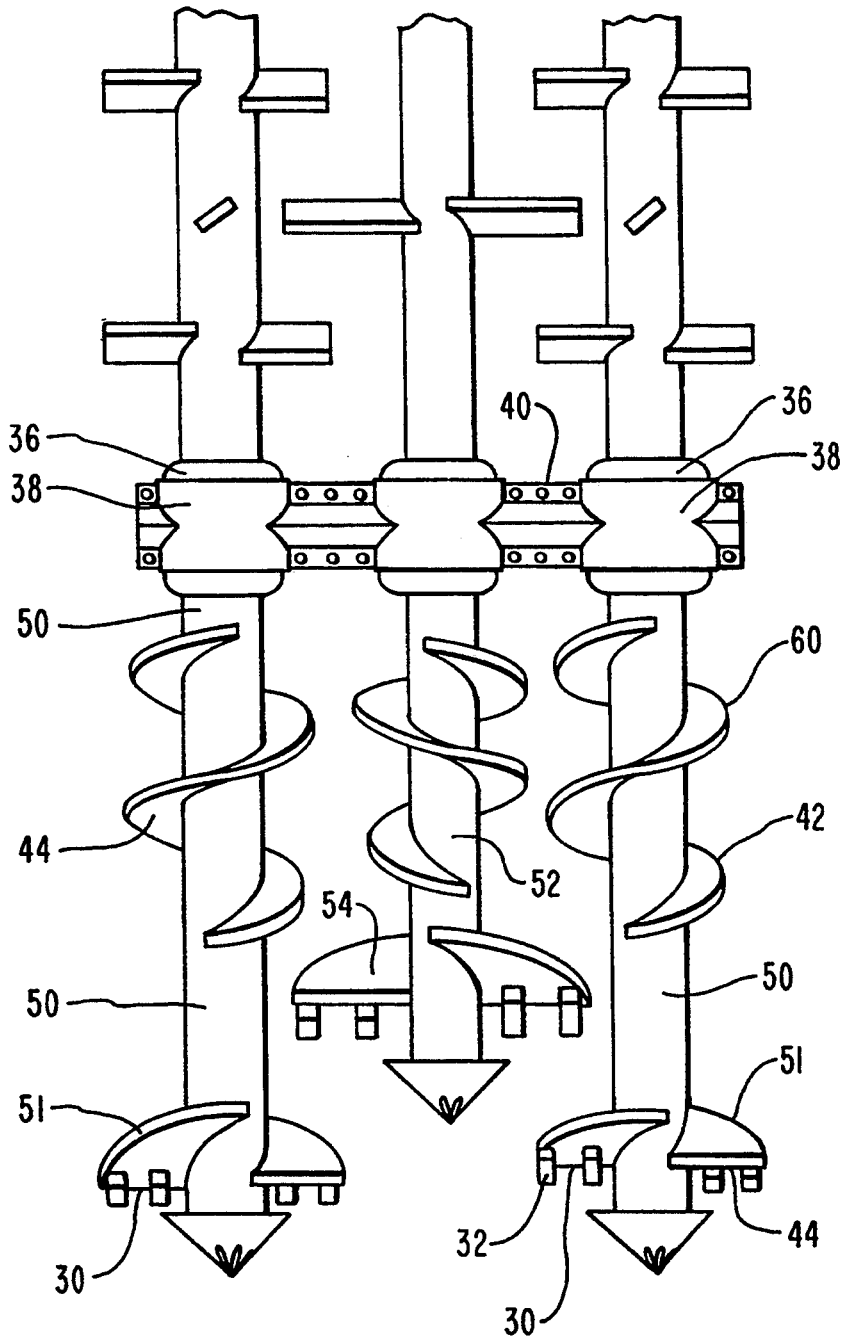
FIG. 3 is a perspective view of the terminal ends of a three-auger system utilizing the teachings of the present invention wherein the spiral flights of the present invention are illustrated.

Referring now to FIG. 3, an embodiment within the scope of the present invention is illustrated used in connection with a three-shaft auger machine.

The three-shaft auger machine contains two outside shafts 50 and a center shaft 52. A pair of outer auger blades 51 are attached to outer shafts 50 and vertically offset from an auger blade 54 attached to center shaft 52.

Generally, each shaft on a multi-shaft auger machine with three or more shafts rotates in a direction opposite the rotation of adjacent shafts. As shown in FIG. 3, auger blade 54 attached to center shaft 52 has a spiral configuration opposite the auger blades attached to outer shafts 50. Thus, if center shaft 52 rotated in a clockwise direction, outer shafts 54 would rotate in a counter-clockwise direction.

After the machine alignment is checked, the auger machine starts to penetrate downwardly through the soil. The process of penetrating downwardly is often referred to as an augering stroke. As the auger blades move down to a predetermined depth, the injection of slurry through the auger shaft is initiated. As the slurry exits the auger shaft, it is mixed with the soil by the auger blades and mixing paddles along the length of each auger.

The resulting soil and slurry mixture is referred to as a column set or borehole. The use of the term "borehole" does not necessarily mean that soil is removed to create a hole. Although some soil is deposited on the surface due to expansion of the soil as it is fractured and mixed, the majority of the soil remains below the surface as it is mixed. Moreover, use of the term column set may refer to a single in situ column set formation or it may generically refer to wall formations or continuous large-area soil formations (sometimes the columns were referred to as "piles"). The column set may be extended to form a grid or a monolithic block of overlapping columns.

The mixing ratio of the slurry to the soil is determined on the basis of the soil conditions which are determined and reported prior to commencing the boring of the columns. The soil-slurry mixing ratio is not decided on the basis of the strength conditions of the continuous wall alone, but such factors as the soil type and condition, and the state of ground water are also taken into consideration in order to obtain a mixing ratio which will result in a substantially homogenous wall which has the desired strength and permeability characteristics. In some cases, special chemical or agent slurries are mixed with in situ soil to stabilize and/or solidify various pollutants in the soil—a procedure named in situ solidification and stabilization or in situ fixation.

Slurry is continuously pumped through the center of the auger shaft and mixed with the soil as the augers penetrate and are then withdrawn from the borehole. In a typical process utilizing the apparatus of the present invention, about 60 percent to 80 percent of the slurry is injected as the augers penetrate downwardly and the remainder is injected as the augers are withdrawn. According to this method, the mixing process is repeated as the augers are withdrawn from the borehole. Auger speed and slurry output quantities are also set to meet the soil conditions of the site and the purposes of soil mixing work.

The resulting mixing of soil and chemical hardener is sometimes referred to as "soilcrete" because the hardener mixture often possesses some physical properties similar to concrete. Nevertheless, use of the term "soilcrete" does not mean that soil is mixed with concrete or that the chemical hardener always contains cement. If cement slurry is used, the preferred term to describe the hardened mixture is soil-cement.

Because the soil at the site of installation is used as an aggregate component material to be mixed with the cement slurry in the construction of the walls, its quality has a direct bearing on the quality of the continuous wall formed according to the methods of the present invention. For this reason, rubble, abandon pipes, pieces of concrete, and other obstructions in the ground should be completely removed and replaced with good quality soil or aggregates. Suitable soil may consist of any ground composition capable of being mixed with a chemical hardener to create barrier walls. Sandy, clay, silty, or rocky compositions are examples of suitable soil compositions. As mentioned previously, however, clay soils tend to reduce both the efficiency of the mixing process and the rate of penetration of the auger shaft through the soil.

To counteract the deleterious effects of clay soil, an auger machine utilizing the teachings of the present invention like the auger machine illustrated in FIG. 3, is provided with soil movement assisting means for aiding in the movement of soil around the support structures.

By way of example and not limitation, the soil movement assisting means in the embodiment illustrated in FIG. 3 comprise a spiral flight such as spiral flight 60 attached to each of outer shafts 50 and central shaft 52. Spiral flight 60 has a diameter which is less than the diameter of the auger blade attached to the same shaft. This reduction in diameter assures that no energy is lost in friction of spiral flight 60 against the sides of the borehole.

To provide enough surface area on spiral flight 60 to both break-up clay plugs and to force the broken soil around the support structures such as nonrotating band 38 and stabilizer bar 40, spiral flight 60 is attached to shafts 50 and 52 for between about 360° and about 720° of rotation of those shafts.

In tests performed with the inventive auger system, increases in boring efficiency of approximately 10 to 15 percent have been experienced. To better understand the dynamic movement of soil within the borehole and the effect of spiral flight 60, reference is now made to FIG. 4.

Figure 4:
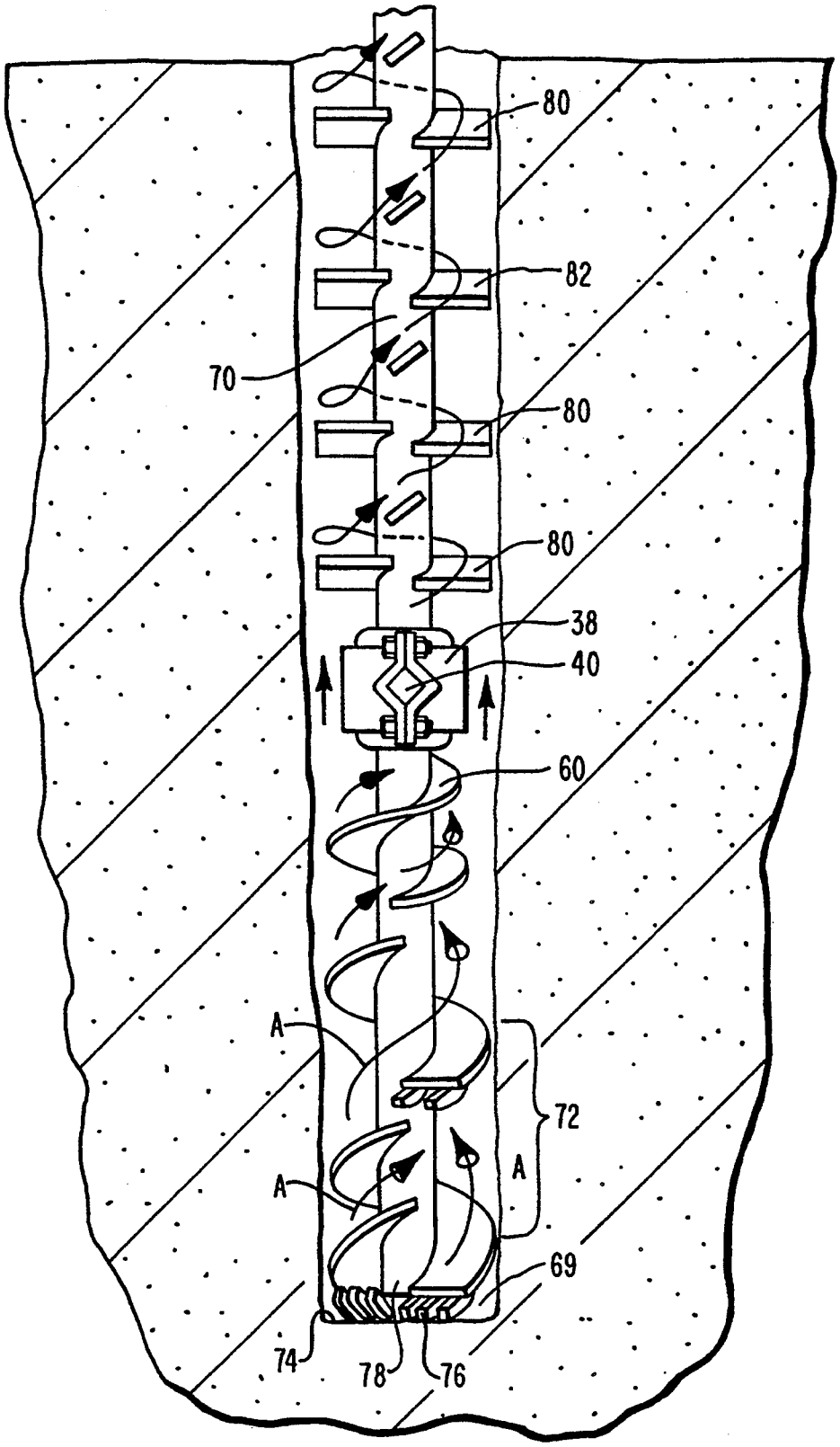
FIG. 4 is a partial vertical cross-sectional elevational view illustrating the movement of soil around a shaft incorporating the apparatus of the present invention.

FIG. 4 is a vertical elevational cross-sectional view of a borehole 69 in which a shaft 70 is operating. A pair of auger blades 72 penetrate unbroken soil at the bottom of a borehole 74. Cutting teeth 76 initially break the soil, after which slurry is injected from the bottom 78 of shaft 70 at the bottom 74 of borehole 69.

Thereafter, auger blades 72 churn and mix the slurry with the broken soil and impart a circular and vertical motion to the broken soil as illustrated by motion lines "A." This circular motion serves to integrate the slurry into the soil to begin the formation of a homogenous soil-slurry column. If the cement slurry is used, the soil-slurry column would harden to form a soil-cement column set.

While the creation of a homogenous mixture preferably utilizes both a down stroke and an upstroke, the initial mixing occurring near the main source of slurry at shaft bottom 78 is vital. As the slurry is absorbed by the broken soil, mixing becomes more difficult. This is especially true with clay soils where the introduction of cement slurry tends to exacerbate the tendency of clay soils to clump and agglomerate in the form of plugs.

A portion of shaft 70 having auger blades 72 attached, pushes the auger shaft further into the earth. Friction between the sides of the borehole 69 and the edges of the auger blades 72 forces the shaft downward. As the shaft travels downward, the soil through which it passes is mixed and pushed in an upward direction with respect to the downward motion of shaft 70. But unlike many auguring devices, the soil is not continuously moved to the top of the borehole so that the soil is removed from the borehole.

Instead, the position of the soil relative to contiguous soil located outside of the borehole remains relatively constant. It is, therefore, the purpose of the structures attached to the shaft above auger blade 72 to continuously remix the soil in an attempt to attain homogeneity of the soil-slurry mixture as the shaft passes through that soil.

As the soil remains relatively static, when compared to the downward motion of the shaft 70, auger blades 72 are required to pull the remaining structures through the borehole. To assist in alleviating the forces born by auger blade 72, therefore, most of the structures located above auger blade 72 are constructed so as to assist in the propulsion of the shaft in a downward direction.

Examples of such structures are paddles 80. Paddles 80 are attached to shaft 70 at an angle so as to impart a downward force on the shaft as the paddles are rotated relative to the soil. While the rotation of paddles 80 does serve to impart a small additional downward pressure on shaft 70, the primary purpose of paddles 80 is to horizontally mix the soil as paddles pass therethrough. Because no real downward pressure is exerted by any structures above auger blades 72, any friction created by structures above auger blade 72 must be overcome by the downward movement of the auger blades through the borehole. Structures such as nonrotating bands 38 and stabilizer bar 40, therefore, must be pulled through the broken soil by the auger blades located at the end of the shaft.

The friction imparted on the shaft by stabilizer bar 40 and nonrotating bands 38 tend to slow the progress of auger blades 72 and also slows the rotational rate of shaft 70. When the auger system is used in clay soils, the friction produced by stabilizer bar 40 and nonrotating bands 38 is greatly increased. Due to the tendency of clay soils to agglomerate almost immediately after passing auger blades 72, the friction produced by the passage of stabilizer bar 40 and nonrotating bands 38 through the clay cylindrical plug formed by recombined clay is substantial.

To overcome some of the friction produced by the passage of stabilizer bar 40 and nonrotating bands 38 through the soil within the borehole, spiral flights 60 are attached to shaft 70 at a point directly below the supporting structures, stabilizer bar 40 and nonrotating band 38. Spiral flights 60 rotate in the same direction as the respective auger shafts to which they are attached. As the spiral flight has a smaller diameter than the auger blade, however, little, if any, friction is created between the sides of the borehole and the edges of the spiral flight.

Spiral flights 60, therefore, do not serve wholly to propel shaft 70 further into the earth, but rather, serve primarily to prevent agglomeration of clay soils into a cylindrical plug. In addition, spiral flights 60 serve to impart a true vertical thrust to the clay soil to force the clay soil around supporting structures such as stabilizer bar 40 and nonrotating band 38.

As used herein, the term vertical thrusting motion refers to motion relative to the soil contiguous to the borehole, and not necessarily to the movement of soil relative to shaft 70. By actually thrusting the soil the short distance around the supporting structures, friction is greatly reduced and the efficiency of the boring process through clay soils is greatly increased. The clay soil does not have a chance to reagglomerate into a cylindrical plug and is thus more easily transported around the supporting structures. Once the auger has descended to a point wherein the soil comes in contact with paddles 80, the soil remains relatively static (vertically) in relation to the soil contiguous to the borehole, and receives a mostly horizontal mixing by paddles 80.

In addition to reducing the friction of the supporting structures against the clay soil passing thereby, spiral flights 60 also serve to improve the homogeneity of the clay soil by continuing the mixing process in the area above auger blade 72 and below paddles 80.

Spiral flights 60, therefore, serve the dual role of increasing the efficiency of the boring process by reducing the friction around the supporting structures, passing therethrough, and in addition, serve to increase the homogeneity of the mixture by increasing the overall mixing of the soil and the slurry.

From the foregoing, it can be seen that the present invention provides a multi-shaft auger system for mixing soils with a chemical hardener in situ which increases the rate of progress of the auger machine through clay soil.

The present invention also allows the multi-shaft auger system to use less energy when penetrating clay soils. The incorporation of the inventive spiral flight prevents the formation of clay cylindrical plugs below the support structures of the auger system. Because the soils are not allowed to reagglomerate, the present invention provides for a more homogeneous mixture of a slurry and a clay soil.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A multi-shaft auger apparatus for mixing soil with a chemical hardener in situ to form a hardened soil-cement column set, the apparatus comprising:

(a) at least two substantially parallel shafts;
(b) means for rotating the shafts;
(c) means securely affixed to each of the shafts for boring downwardly through the soil;
(d) means for injecting the chemical hardener into the soil in the borehole;
(e) a support structure located about each respective shaft such that the support structure does not rotate as each respective shaft rotates in the soil; and
(f) soil movement assisting means for aiding in the movement of soil around the support structure as the shaft moves downwardly through the soil so as to homogeneously mix the soil with the chemical hardener, the soil movement assisting means being affixed to at least one of the shafts and separate from the means for boring downwardly.

2. A multi-shaft auger apparatus for mixing soil with a chemical hardener in situ to form a hardened soil-cement column set as recited in claim 1, wherein the supporting structure comprises a nonrotating band and a stabilizer bar.

3. A multi-shaft auger apparatus for mixing soil with a chemical hardener in situ to form a hardened soil-cement column set as recited in claim 1, further comprising a plurality of soil mixing paddles affixed to each respective shaft.

4. A multi-shaft auger apparatus for mixing soil with a chemical hardener in situ to form a hardened soil-cement column set as recited in claim 1, wherein the soil movement assisting means comprises a spiral flight affixed to the at least one of the shafts.

5. A multi-shaft auger apparatus for mixing soil with a chemical hardener in situ to form a hardened soil-cement column set as recited in claim 1, wherein the means for boring downwardly through the soil comprises an auger blade affixed to the lower end of each respective shaft.

6. A multi-shaft auger apparatus for mixing soil with a chemical hardener in situ to form a hardened soil-cement column set as recited in claim 5, wherein the soil movement assisting means comprise a spiral flight affixed to the auger shaft contiguous with the support structure.

7. A multi-shaft auger apparatus for mixing soil with a chemical hardener in situ to form a hardened soil-cement column set as recited in claim 6, wherein the spiral flight has a diameter less than the diameter of the auger blade.

8. A multi-shaft auger apparatus for mixing soil with a chemical hardener in situ to form a hardened soil-cement column set as recited in claim 1, further comprising three substantially parallel shafts including two outside shafts and a center shaft.

9. A multi-shaft auger apparatus for mixing soil with a chemical hardener in situ to form a hardened soil-cement column set as recited in claim 8, wherein the soil movement assisting means is affixed to each of the two outside shafts.

10. A multi-shaft auger apparatus for mixing soil with a chemical hardener in situ to form a hardened soil-cement column set as recited in claim 1, wherein the soil movement assisting means is affixed to at least one of the shafts at a point less than one meter from the support structure.

11. A multi-shaft auger apparatus for mixing soil with a chemical hardener in situ to form a hardened soil-cement column set as recited in claim 1, wherein the soil movement assisting means is affixed to the respective shaft at a point having a distance from the support structures about 5% to about 10% of the overall length of the shaft.

12. A multi-shaft auger apparatus for mixing soil with a chemical hardener in situ to form a hardened soil-cement column set as recited in claim 1, wherein the soil movement assisting means is removable from the shaft.

13. A multi-shaft auger apparatus for mixing soil with a chemical hardener in situ to form a hardened soil-cement column set as recited in claim 1, wherein the soil movement assisting means is replaceable.

14. A method for in situ formation of a subterranean structure in soil using a multi-shaft auger apparatus having shafts with auger blades at one end and connected by supporting structures to mix a chemical hardener with soil, the method comprising the steps of:

(a) augering a borehole downwardly into and through the soil with the multi-shaft auger apparatus;

(b) forcing soil fractured by the auger blades upwardly through a spiral flight, the spiral flight being separate from the auger blades and attached to the auger shaft around the supporting structures;

(c) injecting the chemical hardener into the soil during augering of the borehole;

(d) blending the soil within the borehole with the chemical hardener; and (e) allowing the soil and chemical hardener blend to cure to form a hardened subterranean structure.

15. A method for in situ formation of a subterranean structure as recited in claim 14, wherein the chemical hardener injected into the soil includes a cement product.

16. A method in situ for formation of a subterranean structure as recited in claim 14, further comprising a step of withdrawing the multi-shaft auger apparatus from the borehole while simultaneously blending the soil with the chemical hardener.

* * * * *

UNITED STATES PATENT AND TRADEMARK OFFICE

CERTIFICATE OF CORRECTION

PATENT NO. : 5,368,415
DATED : November 29, 1994
INVENTOR(S) : IKUO KONO et al.

It is certified that error appears in the above-indentified patent and that said Letters Patent is hereby corrected as shown below:

Column 1, line 67, "slurties" should be --slurries--

Column 10, line 31, delete first occurrence of "the"

Signed and Sealed this

Thirtieth Day of May, 1995

*Attest:*

Bruce Lehman

BRUCE LEHMAN

*Attesting Officer*

*Commissioner of Patents and Trademarks*